US011458732B2

(12) United States Patent
Seki et al.

(10) Patent No.: US 11,458,732 B2
(45) Date of Patent: Oct. 4, 2022

(54) LIQUID EJECTION HEAD AND MANUFACTURING METHOD OF LIQUID EJECTION HEAD

(71) Applicant: CANON KABUSHIKI KAISHA, Tokyo (JP)

(72) Inventors: Sayaka Seki, Kanagawa (JP); Kyosuke Toda, Kanagawa (JP); Shimpei Yoshikawa, Kanagawa (JP); Ryo Sato, Tokyo (JP); Keiichiro Tsukuda, Kanagawa (JP); Kazuhiko Okito, Kanagawa (JP); Kenji Yabe, Kanagawa (JP); Yasuaki Kitayama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/116,945

(22) Filed: Dec. 9, 2020

(65) Prior Publication Data

US 2021/0197566 A1 Jul. 1, 2021

(30) Foreign Application Priority Data

Dec. 25, 2019 (JP) ..... JP2019-234621

(51) Int. Cl.
*B41J 2/16* (2006.01)

(52) U.S. Cl.
CPC ..... *B41J 2/1621* (2013.01); *B41J 2/1601* (2013.01)

(58) Field of Classification Search
CPC .... B41J 2/1621; B41J 2/1601; B41J 2/14024; B41J 2/14145; B41J 2/14; B41J 2/19; B41J 2/055; B41J 2/1632; B41J 2002/14475
See application file for complete search history.

(56) References Cited

U.S. PATENT DOCUMENTS

| | | | |
|---|---|---|---|
| 2005/0073559 | A1 | 4/2005 | Aruga et al. |
| 2010/0214384 | A1 | 8/2010 | Takata |
| 2012/0069093 | A1 | 3/2012 | Kuwata et al. |

FOREIGN PATENT DOCUMENTS

| | | | |
|---|---|---|---|
| CN | 102729632 | A | 10/2012 |
| CN | 110315847 | A | 10/2019 |
| EP | 1525986 | A2 | 4/2005 |
| JP | 2005-145045 | A | 6/2005 |
| JP | 2015107633 | A | 6/2015 |
| JP | 2019-064273 | A | 4/2019 |

*Primary Examiner* — Kristal Feggins

(74) *Attorney, Agent, or Firm* — Canon U.S.A., Inc. I.P. Division

(57) ABSTRACT

A liquid ejection head includes an element substrate having an energy-generating element configured to generate an energy for ejecting a liquid from an ejection orifice, a support member for supporting the element substrate, the support member including a liquid chamber formed therein to supply the liquid to the ejection orifice, and a damper portion for absorbing vibration of the liquid inside the liquid chamber, the damper portion being flexible. The support member has a through-hole for communicating with the liquid chamber at a position located above the liquid chamber in a vertical direction when the liquid ejection head is in a use orientation. The damper portion has a taper portion that tapers downwardly in the vertical direction and is positioned in such a manner that the tapering portion closes the through-hole, and the damper portion and the support member are attached to each other by a fixing member.

18 Claims, 7 Drawing Sheets

LIQUID EJECTION HEAD AND MANUFACTURING METHOD OF LIQUID EJECTION HEAD

BACKGROUND

Field of the Disclosure

The present disclosure relates to a liquid ejection head and a manufacturing method of the liquid ejection head.

DESCRIPTION OF THE RELATED ART

A liquid ejection head as a means for forming a photograph, a document, or a 3-dimensional structure is configured to eject a plurality of kinds of liquids such as inks from an element substrate provided with an ejection orifice therein. If a large volume of liquid is ejected by one ejection operation due to the formation of multiple nozzles, or the liquid is ejected at shorter ejection intervals for achieving high speed recording, the ejection amount of liquid per hour becomes large, and thereby the vibration of the liquid inside the ejection orifice is likely to be increased. If the liquid is ejected before the vibration of the liquid is sufficiently ceased, recording quality may possibly be adversely affected.

Japanese Patent Application Laid-Open No. 2015-107633 discusses a liquid ejection head that includes a liquid chamber from which a liquid is supplied to an ejection orifice and a flexible damper portion in part of a supporting member (part of a ceiling or wall surface of the liquid chamber) for supporting an element substrate. Since the damper portion is made of a flexible material, its shape can be deformed according to the vibration of the liquid in the liquid chamber so as to absorb the vibration of the liquid, thereby restraining the vibration of the liquid inside the ejection orifice.

In the liquid ejection head discussed in Japanese Patent Application Laid-Open No. 2015-107633, the damper portion provided on the wall surface of the liquid chamber is bonded to the supporting member including the liquid chamber only by adhesive force between the supporting member and the damper portion, so that the adhesion therebetween may not be so high. Therefore, if a liquid contacts the bonding portion between the support member and the damper portion, the liquid inside the liquid chamber may possibly leak out to the outside via the close contact portion.

Moreover, air bubbles that are generated by ejecting the liquid or at the like occasion may enter the liquid chamber in some cases. If a recess portion where the air bubbles can be accommodated is formed inside the liquid chamber, the air bubbles may be accumulated in the recess portion in some cases. The air bubbles accumulated in the recess portion may enter the ejection orifice, thereby deteriorating the liquid ejection performance in ejection of the liquid from the ejection orifice.

SUMMARY

An aspect of present disclosure is providing a liquid ejection head including a liquid chamber that allows high adhesion between a supporting member and a damper portion while preventing air bubbles from accumulating inside the liquid chamber.

According to an aspect of the present disclosure, a liquid ejection head includes an element substrate having an energy-generating element configured to generate an energy for ejecting a liquid from an ejection orifice, a support member for supporting the element substrate, the support member including a liquid chamber formed therein to supply the liquid to the ejection orifice, and a damper portion for absorbing vibration of the liquid inside the liquid chamber, the damper portion being flexible. The support member has a through-hole for communicating with the liquid chamber at a position that is located above the liquid chamber in a vertical direction when the liquid ejection head is in a use orientation. The damper portion has a taper portion that tapers downwardly in the vertical direction and is positioned in such a manner that the taper portion closes the through-hole, and the damper portion and the support member are attached to each other by a fixing member.

Further features of the present disclosure will become apparent from the following description of exemplary embodiments with reference to the attached drawings.

DESCRIPTION OF THE EMBODIMENTS

In the following description, exemplary embodiments of the present disclosure will be described with reference to the drawings.

First Exemplary Embodiment (Liquid Ejection Head)

Figure 1A:
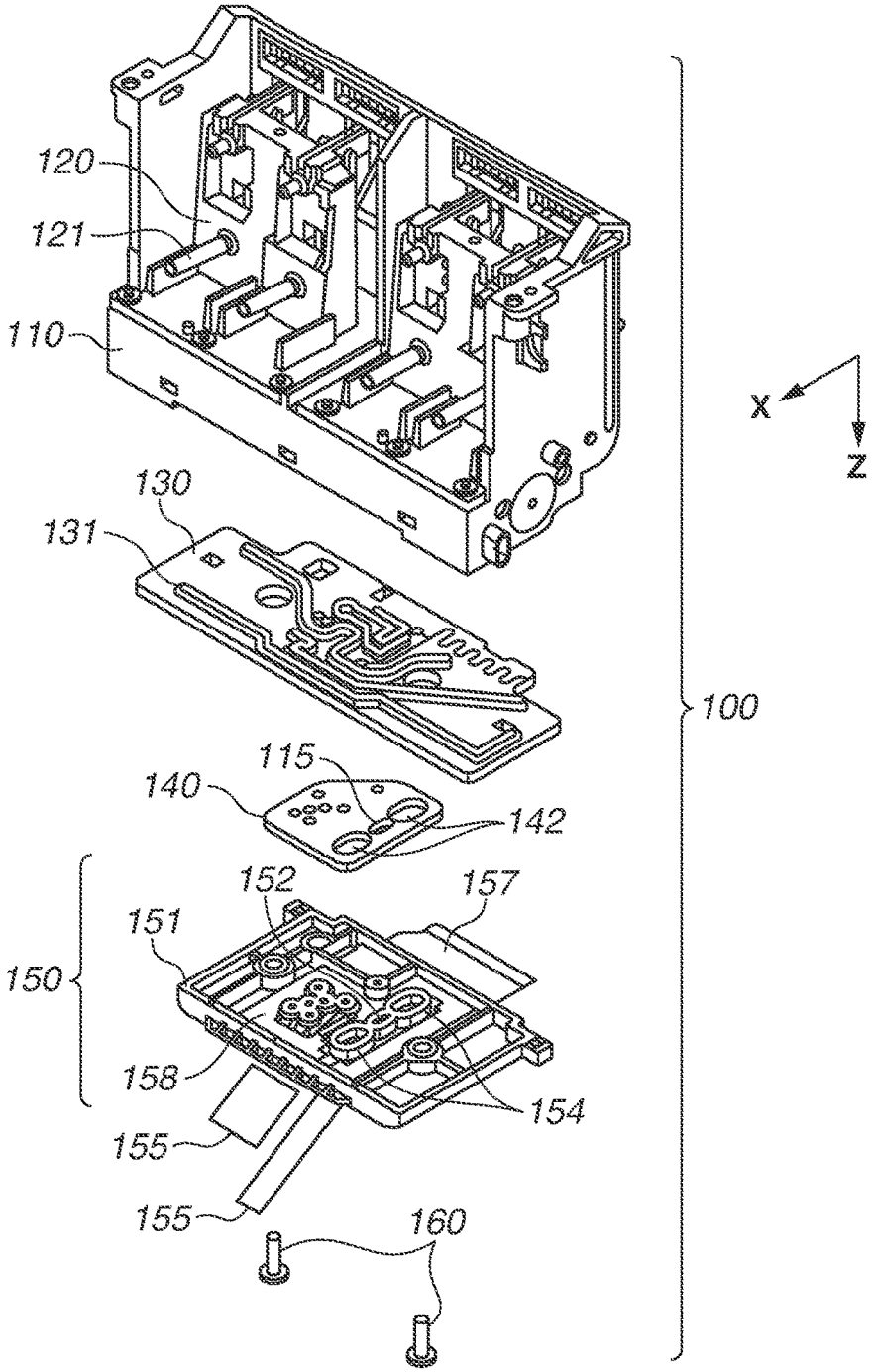
FIGS. 1A and 1B are diagrams illustrating configurations of a liquid ejection head and an element substrate, respectively.
Figure 1B:
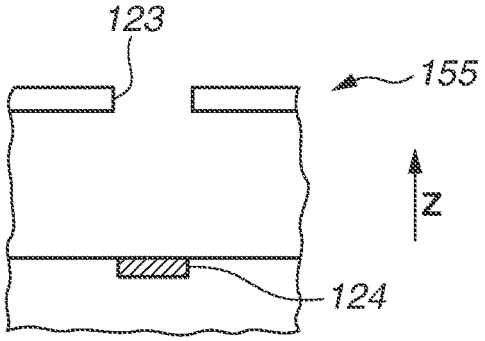

FIG. 1A is an exploded perspective diagram illustrating a liquid ejection head 100 according to the present exemplary embodiment. FIG. 1B a diagram schematically illustrating a cross section of a configuration in the vicinity of an ejection orifice 123 of an element substrate 155 from which a liquid is ejected. The liquid ejection head 100 mainly includes a sub tank 120, a housing 110, a flow path member 130, and a recording element unit 150, and these members are fixed to each other by fixing members 160. In the present exemplary embodiment, screws are used as the fixing members 160. The sub tank 120 is a tank for storing a liquid (ink) supplied from a main tank (not illustrated), in which the liquid is stored, in the liquid ejection head 100. The flow path member 130 has a flow path 131 for supplying the liquid from the sub tank 120 to an element substrate 155. The recording element unit 150 includes the element substrate 155 that ejects the liquid therefrom, a support member 151 that supports the element substrate 155, and a flexible substrate 157 electrically connected to the element substrate 155. The support member 151 is in contact with the element substrate 155 by use of an adhesive agent (not illustrated). Moreover, the support member 151 may be made of, for example, an alloy of iron and stainless steel material (SUS), such as carbon steel (S45C), an inorganic material such as silicon, ceramics, or a resin material such as an epoxy resin. The support member 151 is desirably resistant to corrosion.

A sealing member 140 is provided between the flow path member 130 and the recording element unit 150. The sealing member 140 includes damper portions 142 for absorbing (restraining) vibration of the liquid, and a sealing portion 115 for preventing leakage of the liquid. The damper portions 142 are formed of a flexible material. More specifically, examples of the flexible material include a resin material such as an epoxy resin, a thermoplastic elastomer, a thermoset elastomer, and silicone rubber. The damper portions 142 only need to contain at least one of these resin materials. With the damper portions 142 provided inside a liquid chamber 101 (see FIG. 4), the vibration of the liquid inside the liquid chamber 101 can be restrained by the damper portions 142 being deformable according to the vibration of the liquid. The sealing portion 115 is also formed of a flexible material, similarly. More specifically, examples of the flexible material include a resin material such as an epoxy resin, a thermoplastic elastomer, a thermoset elastomer, and silicone rubber. The sealing portion 115 only needs to contain at least one of these resin materials. The sealing portion 115 prevents leakage of the liquid from a portion between the flow path 131 of the flow path member 130 and the recording element unit 150. The liquid supplied from the main tank flows or passes through the flow path member 130, the sealing portion 115 of the sealing member 140, a supply port 152 of the support member 151, and the liquid chamber 101 in this order and then is supplied to the ejection orifice 123. A portion 116 of the sealing member 140 other than that damper portions 142 and the sealing portion 115 is formed of a non-flexible material (such as plastic or metal). That is, the sealing member 140 consists of a flexible member and a non-flexible member.

As illustrated in FIG. 1B, the element substrate 155 is provided with an energy-generating element 124 configured to generate energy for ejecting the liquid from the ejection orifice 123. Although the FIG. 1B illustrates a heat-generating element as an example of the energy-generating element 124, the energy-generating element according to the present exemplary embodiment is not limited thereto. That is, a piezoelectric element may be used as the energy-generating element 124 instead. Driving the energy-generating element 124 causes film boiling of the liquid, and then the liquid is ejected from the ejection orifice 123.

(Internal Configuration of Liquid Ejection Head)

Figure 2:
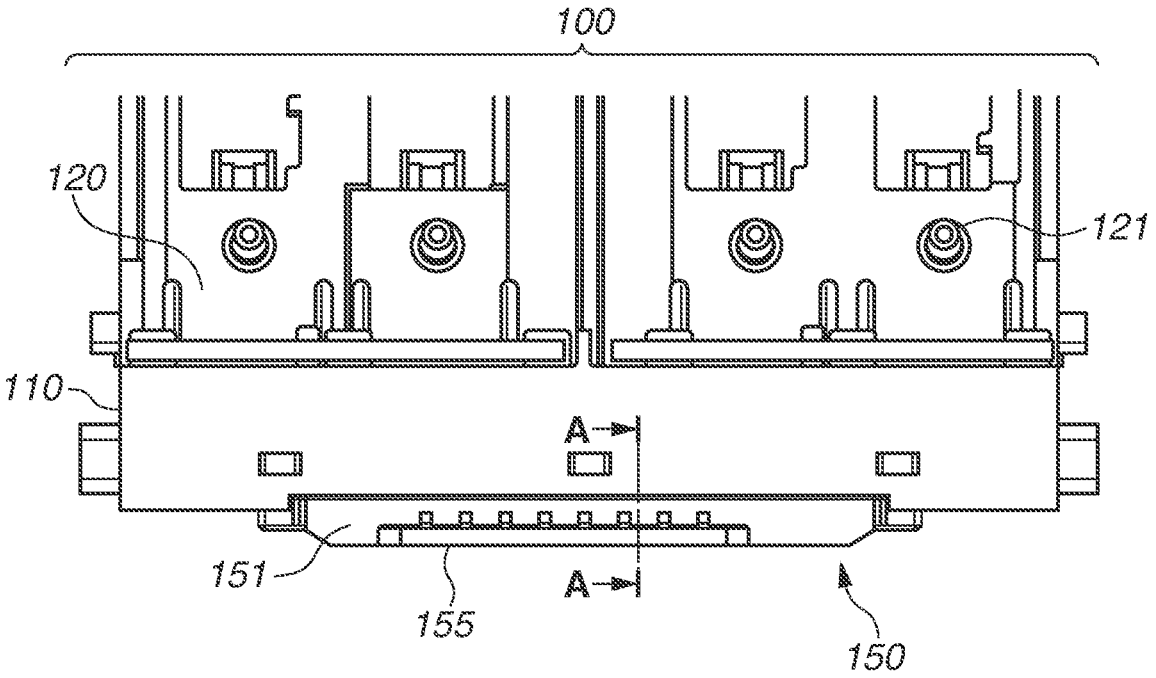
FIG. 2 is a front view illustrating the liquid ejection head.
Figure 3:
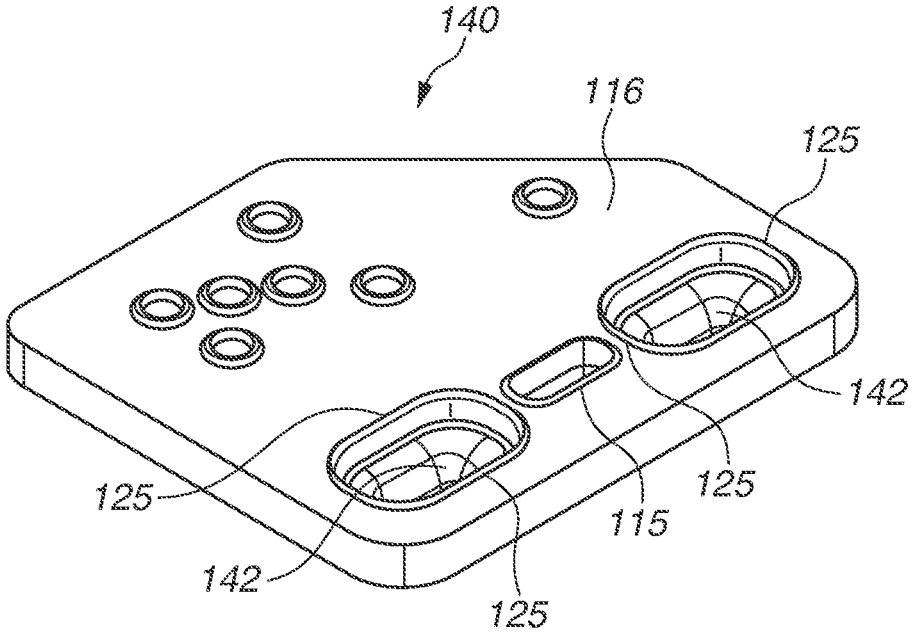
FIG. 3 is a perspective view illustrating a sealing member.
Figure 4:
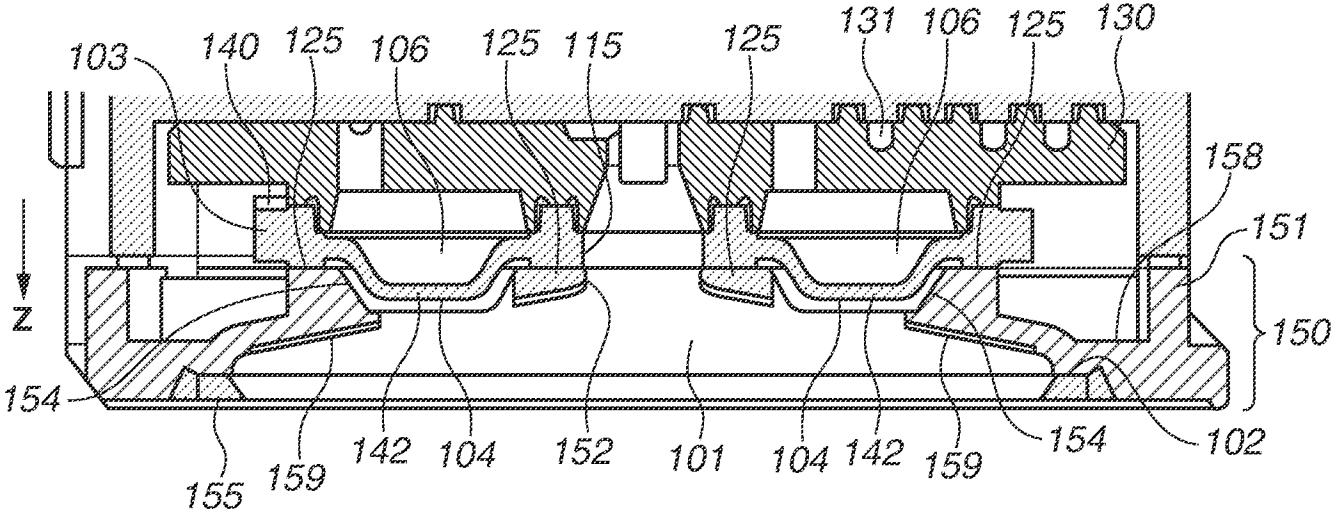
FIG. 4 is a cross-sectional diagram of the liquid ejection head taken along a cross portion A-A in FIG. 2.

FIG. 2 is a front view of a part of the liquid ejection head 100 in FIGS. 1A and 1B in a state where the liquid ejection head 100 is finished. FIG. 3 is a perspective view illustrating the sealing member 140. FIG. 4 is a cross-sectional diagram illustrating a cross section taken along A-A in FIG. 2. The liquid is supplied from the main tank to the liquid chamber 101 via a tube (not illustrated) connected to a liquid connecting portion 121.

As illustrated in FIG. 4, the sealing member 140 is provided on a second surface 103 of the support member 151, which is a back surface of a surface 102 (first surface) of the support member 151 on which the element substrate 155 is supported. The sealing member 140 is provided in such a way that the damper portions 142 of the sealing member 140 close through-holes 154. The liquid chamber 101 has a shape that tilts with respect to the first surface 102 supporting the element substrate 155 such that a cross-sectional area of the liquid chamber 101 gradually increases from the upper side toward the bottom side in a vertical direction (in a Z direction) (hereinafter, the liquid chamber 101 is also referred to as a triangular liquid chamber 101). With the liquid chamber 101 having the shape, it is possible to prevent turbulence of the liquid flowing in the vicinity of wall surfaces of the liquid chamber 101 after the liquid is supplied from the supply port 152 into the liquid chamber 101. As a result, it can prevent the air bubbles that have entered the liquid chamber 101 from accumulating in the vicinity of the wall surface (ceiling) of the liquid chamber 101.

On a surface 159 corresponding to the ceiling of the liquid chamber 101 (hereinafter, the surface 159 is simply referred to as the ceiling 159), the damper portions 142 are formed in such a way that the damper portions 142 are tightly in contact with the support member 151. Accordingly, the through-holes 154 are formed so as to communicate with the liquid chamber 101 at positions that are located above the liquid chamber 101 in the vertical direction when the liquid ejection head 100 is in an orientation in use (orientation illustrated in FIG. 4). An abutting portion 125 is provided (abutted) on the surface (second surface) 103 on the flow path member side of the support member 151, which corresponds to an upper surface of the support member 151. The abutting portion 125 is formed of the same material as that of the damper portions 142 and integrally formed with the damper portions 142. The support member 151 and the damper portions 142 are firmly fixed to each other by using the fixing members 160 (see FIGS. 1A and 1B). In this way, the support member 151 and the damper portions 142 are firmly fixed to each other by stresses that the support member 151 and the damper portion 142 mutually apply to each other by the fixing members 160 in a state where the damper portions 142 are provided on the ceiling 159 of the liquid chamber 101. This makes it possible to form the liquid chamber 101 with the support member 151 and the damper portions 142 tightly in contact with each other, thereby having high adhesion therebetween.

Furthermore, the damper portions 142 each have such a shape that tapers downwardly in the vertical direction in the orientation illustrated in FIG. 4. The damper portions 142 with this shape are provided in such a way that the damper portions 142 close the through-holes 154 of the support member 151, thereby making it possible to prevent a formation of such a recess portion that can possibly include air bubbles therein inside the liquid chamber 101. Therefore, according to the present exemplary embodiment, it is possible to form the liquid chamber 101 that can reduce accumulation of air bubbles inside the liquid chamber 101, while assuring high adhesion between the support member 151 and the damper portions 142 that are tightly in contact with each other.

Figure 7:
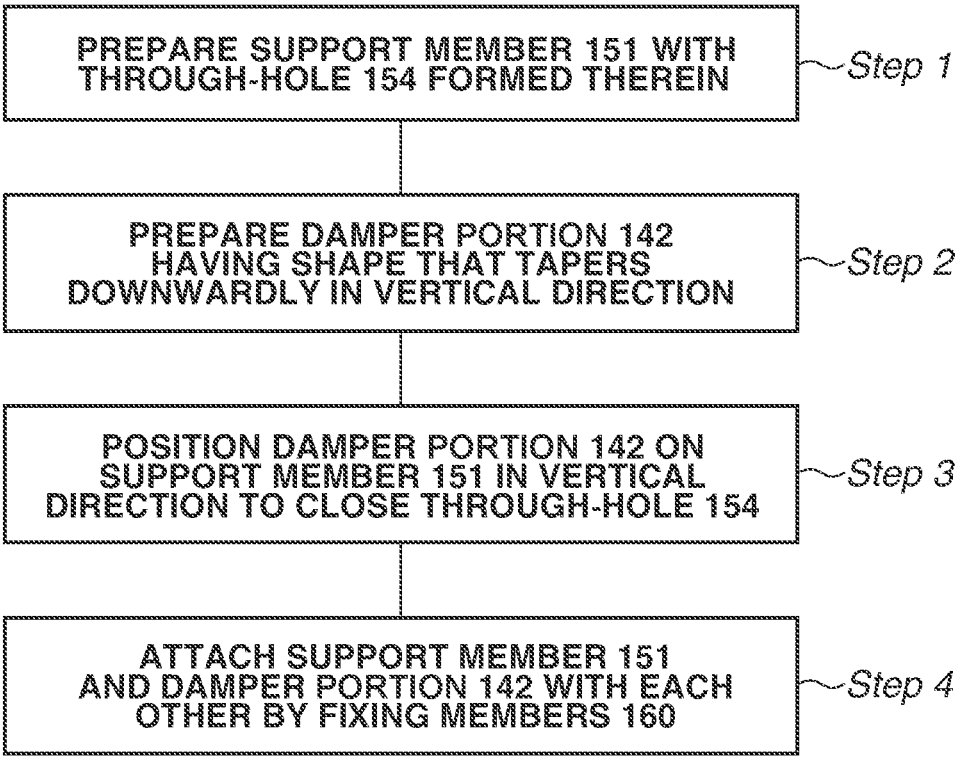
FIG. 7 is a flowchart illustrating a manufacturing process of a liquid ejection head.

Next, a manufacturing method of the liquid ejection head 100 will be described with reference to FIG. 7. FIG. 7 is a flowchart illustrating a manufacturing process of manufacturing the liquid ejection head 100. In step S1, a support member 151 with through-holes 154 formed therein is prepared. Next in step S2, damper portions 142 each having a shape that tapers downwardly in the vertical direction are prepared. Then in step S3, the damper portions 142 are positioned on the support member 151 in the vertical direction in such a way that the tapered-shaped portions of the damper portions 142 close the through-holes 154 of the support member 151. In step S4, the support member 151 and the damper portions 142 are attached to each other by fixing members 160. In this way, a liquid ejection head 100 is manufactured. The support member 151 and the damper portions 142 are firmly fixed to each other while mutually applying stresses to each other, thereby assuring high adhesion between the support member 151 and the damper portions 142 that are tightly in contact with each other. Moreover, with the shape of each of the damper portions 142 that tapers downwardly in the vertical direction, the damper portions 142 close the through-holes 154. Accordingly, it becomes possible to prevent a formation of such an undesirable recess portion (gap) inside the liquid chamber 101 where air bubbles can accumulate therein, thereby making it possible to prevent the air bubbles stay inside the liquid chamber 101.

(Atmosphere Communication Path)

Figure 5A:
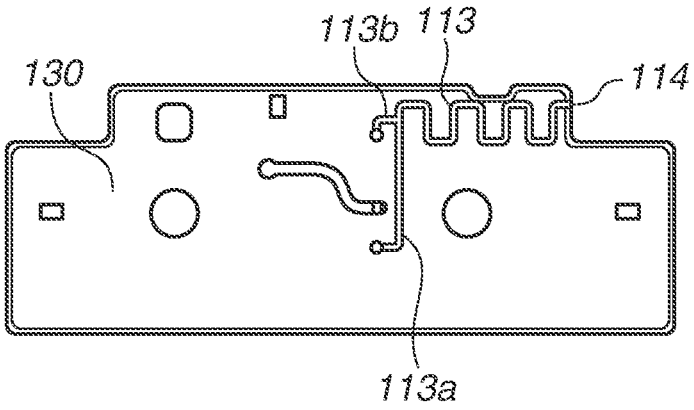
FIGS. 5A and 5B are diagrams each schematically illustrating a flow path member.
Figure 5B:
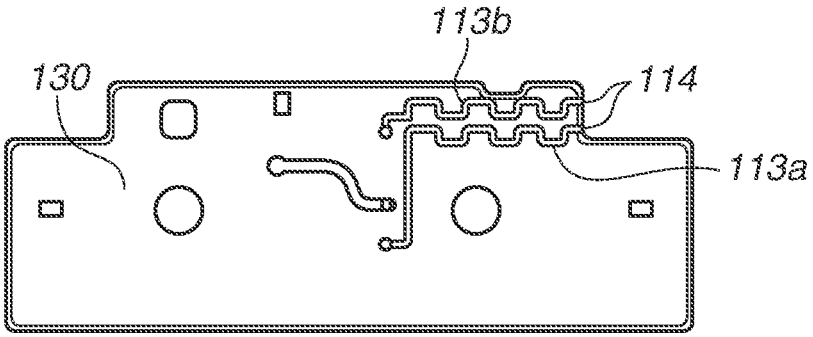

FIG. 5A is a top view illustrating the flow path member 130. FIG. 5B is a view illustrating a modification of the flow path member 130 illustrated in FIG. 5A. Space portions 106 for communicating with atmosphere are formed on a back side of the surface of each damper portion 142 facing the liquid chamber 101. This configuration allows the damper portions 142 to be easily deformable. An atmosphere communication path 113 for communicating with the space portions 106 and atmosphere is formed in the flow path member 130. In FIGS. 5A and 5B, a first atmosphere communication path 113*a* and a second atmosphere communication path 113*b* are formed in the flow path member 130. The first atmosphere communication path 113*a* is an atmosphere communication path connected with a space portion 106 (first space portion) on the back surface side of a damper portion 142 (first damper portion) that is illustrated as a right one of the two damper portions 142 in FIG. 4. The second atmosphere communication path 113*b* is an atmosphere communication path connected with a space portion 106 (second space portion) on the back surface side of a damper portion 142 (second damper portion) that is illustrated as a left one of the two damper portions 142 in FIG. 4. That is, the space portions 106 on the back surface side of the damper portions 142 are open to the atmosphere via the atmosphere communication path 113. With the damper portions 142 made of a resin material as described above, a volatile component of the liquid in the liquid chamber 101 gradually transmits through the damper portions 142 over time and moves into the atmosphere communication path 113. Because the atmosphere communication path 113 communicate with the atmosphere, the volatile component of the liquid in the liquid chamber 101 gradually evaporates via the atmosphere communication path 113. A greater cross-sectional area of the atmosphere communication path 113 results in a greater amount of evaporation of the liquid, and a longer length of the atmosphere communication path 113 results in a smaller amount of evaporation of the liquid. Thus, in order to reduce the amount of evaporation of the liquid, the first and second atmosphere communication path 113 is bent plural times, so that the length of the atmosphere communication path 113 is increased. In FIG. 5A, flow paths of the first and second atmosphere communication paths 113*a* and 113*b* are merged into each other. This makes it possible to form the longer atmosphere communication path 113 in a smaller region.

Moreover, the first and second atmosphere communication paths 113*a* and 113*b* may be independently formed (without merging into each other) as illustrated in FIG. 5B. With the configuration as illustrated in FIG. 5B, it becomes possible to prevent a pressure change in one space portion 106 (the first space portion) from affecting the pressure in the other space portion 106 (the second space portion), so that the damper portions 142 can stably restrain the vibration of the liquid.

The space portions 106 may not be communicated with the atmosphere, even though the space portions 106 have been described to be communicated with the atmosphere in the above description. That is, the space portions 106 may be closed spaces. If the space portions 106 have a certain volume, the damper portions 142 can deform according to the vibration of the liquid, thereby functioning as a damper even if the space portions 106 are closed spaces. However, if the space portions 106 are closed spaces, the pressures in the space portions 106 will change in such a way that the pressures change to prevent the deformation of the damper portions 142 when the damper portions 142 is/are vibrated according to the vibration of the liquid. Therefore, it is desirable that the pressures in the space portions 106 be kept constant in order to prevent such a phenomenon that the pressure changes inside the space portions 106 hinder the deformation of the damper portions 142. That is, it is more desirable that the space portions 106 are communicated with the atmosphere.

Second Exemplary Embodiment

Figure 6:
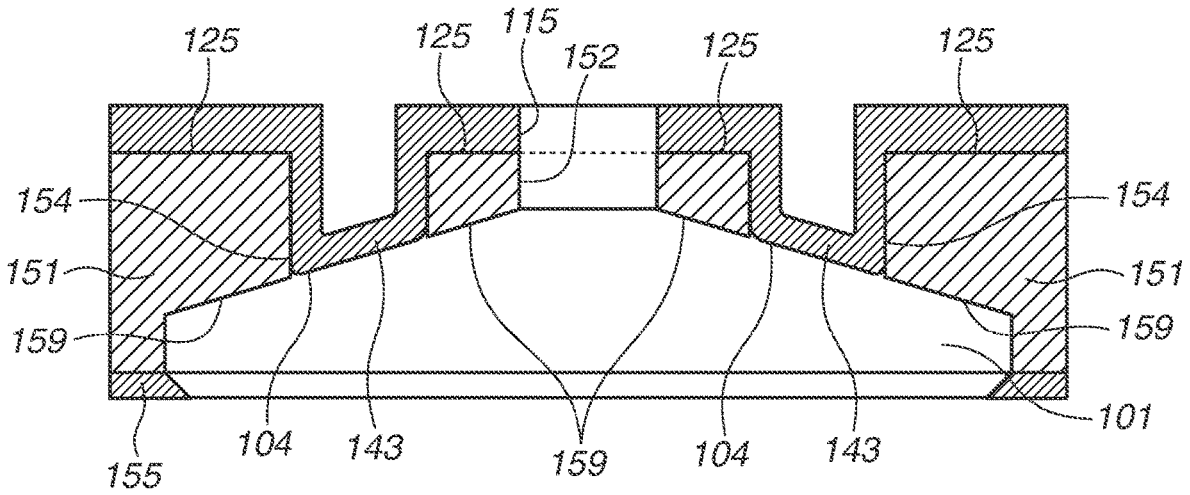
FIG. 6 is a cross-sectional diagram of a liquid ejection head according to a second exemplary embodiment.

A second exemplary embodiment will be described with reference to FIG. 6. FIG. 6 is a diagram schematically illustrating a case where damper portions 143 are provided on a ceiling 159 of a liquid chamber 101 according to the second exemplary embodiment. As illustrated in FIG. 6, the damper portions 143 according to the second exemplary embodiment are provided in such a way that a surface having a convex shape (lower surface) 104 of each of the damper portions 143 tilts along a slant surface of the ceiling 159 of the triangular liquid chamber 101. Here, what is meant by the expression "tilting along" is that a slant angle of the ceiling 159 with respect to an element substrate 155 and a slant angle of the lower surface 104 of the damper portion 143 with respect to the element substrate 155 are substantially equal to each other and the lower surface 104 is an extension of the plane of the ceiling 159. What is meant by the expression "substantially equal angles" is that a difference between the slant angle of the ceiling 159 on the assumption that the ceiling 159 is flat and the slant angle of the lower surface 104 on the assumption that the lower surface 104 is flat is within 10 degrees. With the configuration where the lower surface 104 of the damper portion 143 is provided along the ceiling 159 of the triangular liquid chamber 101 in a slanted manner, each gap between through-holes 154 and the damper portions 143 can be minimized. This makes it possible to prevent such a phenomenon that air bubbles that have entered into the liquid chamber 101 are caught in the gaps between the damper portions 143 and the through-holes 154 and then kept inside the liquid chamber 101 which can cause the air bubbles to enter the ejection orifice 123 as a result.

According to the exemplary embodiments of the present disclosure, it is possible to form a liquid chamber having a high adhesion between a support member and a damper portion while preventing air bubbles from staying inside the liquid chamber.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-234621, filed Dec. 25, 2019, which is hereby incorporated by reference herein in its entirety.

What is claimed is:

1. A liquid ejection head comprising:

an element substrate having an energy-generating element configured to generate an energy for ejecting a liquid from an ejection orifice;

a support member for supporting the element substrate, the support member including a liquid chamber formed therein to supply the liquid to the ejection orifice; and a damper portion for absorbing vibration of the liquid inside the liquid chamber, the damper portion being flexible, wherein the support member has a through-hole for communicating with the liquid chamber at a position that is located above the liquid chamber in a vertical direction when the liquid ejection head is in a use orientation, wherein the damper portion has a protrusion portion that protrudes downward in the vertical direction and is positioned in such a manner that protrusion portion closes the through-hole, and wherein the damper portion and the support member are attached to each other by a fixing member.

2. The liquid ejection head according to claim 1, wherein the damper portion is made of a resin material including at least one of an epoxy resin, a thermoplastic elastomer, a thermoset elastomer, or silicone rubber.

3. The liquid ejection head according to claim 1, further comprising: a flow path member having a flow path for supplying the liquid to the liquid chamber, wherein the damper portion is provided between the flow path member and the support member, and wherein the damper portion and the support member are attached to each other by the fixing member in a state where an abutting portion connected with the damper portion abuts a surface of the support member on a flow path member side.

4. The liquid ejection head according to claim 3, wherein a supply port communicating with the flow path of the flow path member is formed in the liquid chamber, wherein a sealing member having a sealing portion for connecting the flow path and the supply port with each other by sealing the flow path and the supply port is provided between the flow path member and the support member, and wherein the damper portion and the abutting portion are formed in the sealing member.

5. The liquid ejection head according to claim 3, wherein the abutting portion is made of a resin material including at least one of an epoxy resin, a thermoplastic elastomer, a thermoset elastomer, or silicone rubber.

6. The liquid ejection head according to claim 1, wherein the liquid chamber has a shape such that a cross-sectional area thereof gradually increases from an upper side to a lower side in the vertical direction.

7. The liquid ejection head according to claim 6, wherein a surface forming a wall of the liquid chamber on the upper side in the vertical direction, tilts with respect to a surface of the support member supporting the element substrate.

8. The liquid ejection head according to claim 7, wherein a surface of the protrusion portion of the damper portion, tilts with respect to the surface of the support member supporting the element substrate.

9. The liquid ejection head according to claim 8, wherein the surface of the protrusion portion of the damper portion is an extension of the surface forming the wall of the liquid chamber on the upper side in the vertical direction.

10. The liquid ejection head according to claim 1, wherein a surface of the protrusion portion of the damper portion is arranged along a surface of the support member supporting the element substrate.

11. The liquid ejection head according to claim 1, wherein the fixing member is a screw.

12. The liquid ejection head according to claim 1, wherein the support member is in contact with the element substrate.

13. The liquid ejection head according to claim 1, wherein a space portion is formed on a back side of a surface of the damper portion facing the liquid chamber.

14. The liquid ejection head according to claim 13, wherein the space portion is communicated with atmosphere.

15. The liquid ejection head according to claim 13, wherein the space portion is connected with an atmosphere communication path communicating with atmosphere, and wherein the atmosphere communication path is bent a plurality of times.

16. The liquid ejection head according to claim 15, wherein the damper portion includes a first damper portion and a second damper portion, wherein the space portion includes a first space portion and a second space portion, the first space portion being on a back side of a surface of the first damper portion facing the liquid chamber, and the second space portion being on a back side of a surface of the second damper portion facing the liquid chamber, and wherein a first atmosphere communication path connected with the first space portion and a second atmosphere communication path connected with the second space portion do not merge into each other.

17. The liquid ejection head according to claim 15, wherein the damper portion includes a first damper portion and a second damper portion, wherein the space portion includes a first space portion and a second space portion, the first space portion being on a back side of a surface of the first damper portion facing the liquid chamber, and the second space portion being on a back side of a surface of the second damper portion facing the liquid chamber, and wherein a first atmosphere communication path connected with the first space portion and a second atmosphere communication path connected with the second space portion merge into each other.

18. A method for manufacturing a liquid ejection head including:

an element substrate having an energy-generating element configured to generate an energy for ejecting a liquid from an ejection orifice;

a support member for supporting the element substrate, the support member including a liquid chamber formed therein to supply the liquid to the ejection orifice; and a damper portion for absorbing vibration of the liquid inside the liquid chamber, the damper portion being flexible, the method comprising:

preparing the support member having a through-hole for communicating with the liquid chamber at a position that is located above the liquid chamber in a vertical direction when the liquid ejection head is in a use orientation;

preparing the damper portion having a protrusion portion that protrudes downward in the vertical direction;

positioning the damper portion on an upper side of the support member in the vertical direction in such a manner that the protrusion portion closes the through-hole; and attaching the damper portion and the support member to each other by a fixing member.

* * * * *